US011614273B2

(12) United States Patent
Rothe

(10) Patent No.: US 11,614,273 B2
(45) Date of Patent: Mar. 28, 2023

(54) CONTAINER ASSEMBLY, SUPPORT STRUCTURE AND METHODS

(71) Applicant: MAMMAWAY LLC, Washington, IL (US)

(72) Inventor: Jillian J. Rothe, Greenwood Village, CO (US)

(73) Assignee: MAMMAWAY LLC, Englewood, CO (US)

( * ) Notice: Subject to any disclaimer, the term of this patent is extended or adjusted under 35 U.S.C. 154(b) by 22 days.

(21) Appl. No.: 17/048,726

(22) PCT Filed: Apr. 19, 2019

(86) PCT No.: PCT/US2019/028358
§ 371 (c)(1),
(2) Date: Oct. 19, 2020

(87) PCT Pub. No.: WO2019/204752
PCT Pub. Date: Oct. 24, 2019

(65) Prior Publication Data

US 2021/0239388 A1 Aug. 5, 2021

(30) Foreign Application Priority Data

Apr. 19, 2018 (SG) ..... 10201803279S

(51) Int. Cl.
*F25D 25/00* (2006.01)
*F25C 1/243* (2018.01)

(52) U.S. Cl.
CPC ..... *F25D 25/005* (2013.01); *F25C 1/243* (2013.01); *F25D 2331/801* (2013.01); *F25D 2331/809* (2013.01)

(58) Field of Classification Search
CPC ..... F25D 25/005; F25D 2331/801; F25D 2331/809; F25C 1/243
See application file for complete search history.

(56) References Cited

U.S. PATENT DOCUMENTS 5,620,133 A * 4/1997 Isserstedt ..... B42F 7/06 229/67.2
8,146,762 B2 4/2012 Leoncavallo et al.
(Continued)

FOREIGN PATENT DOCUMENTS

CN 201431140 Y * 3/2010
CN 201431140 Y 3/2010

OTHER PUBLICATIONS

Translated_Chen (Year: 2010).*
Search Report issued for International Application No. PCT/US2019/028358, dated Aug. 9, 2019.

*Primary Examiner* — Elizabeth J Martin
*Assistant Examiner* — Samba Gaye
(74) *Attorney, Agent, or Firm* — Holzer Patel Drennan

(57) ABSTRACT

A container assembly comprises a V-shaped container having a V-shaped cross-section and being formed from freezer-safe material, and a support base having a V-shaped groove sized to received and cooperate with the container thereby to support the container during filling with freezable liquid. Also disclosed is a freezer container support structure comprising two or more plates and at least two spaced support members. The support members are adapted to engage the plates in spaced locations along the support members, to maintain one or more freezer containers between the plates during freezing of a freezable liquid contained in each said freezer container.

18 Claims, 10 Drawing Sheets

(56) References Cited

U.S. PATENT DOCUMENTS

| | | | | |
|---|---|---|---|---|
| 9,279,610 | B2 * | 3/2016 | Wang | F25D 25/005 |
| 2006/0148646 | A1 | 7/2006 | Pursell et al. | |
| 2016/0324283 | A1 | 11/2016 | Kane | |

* cited by examiner

CONTAINER ASSEMBLY, SUPPORT STRUCTURE AND METHODS

TECHNICAL FIELD

The present invention relates to a container assembly, freezer container support structure and methods relating to the selective access and storage of freezable liquids. The present invention relates, in particular, to the use of such assemblies, structures and methods in the storage and use of breast milk.

BACKGROUND

Currently, freezable liquids such as breast milk are typically stored in plastic bags or glass bottles. The bags are expensive, prone to leakage, usually single-use and thus result in a significant amount of liquid and plastic waste.

Glass bottles are also sometimes used for the purpose of containing liquids for freezing. However, glass bottles are an even more expensive, bulky, hard to organise in a freezer compartment (e.g. the freezer compartment of a domestic refrigerator) and can fracture upon expansion of the liquid during freezing.

During use, bottles can be overlooked resulting in newer breastmilk being used in advance of breastmilk that has been frozen for longer. This results in some breastmilk going bad as it passes its useful shelf-life.

A reusable alternative to bottles is an ice cube tray. Ice cube trays typically occupy considerably more volume than the volume of liquid intended to be frozen in the trays. To conserve space, frozen cubes are transferred to bags. However, once in bags the milk is highly susceptible to freezer burn, rendering the milk unusable.

On a survey of women who use some current methods of freezing breastmilk:

(a) 38% think the freezing and usage process a waste of plastic;

(b) 16% think the ice cube trays, jars or bags take up too much freezer space; and (c) 40% think the current freezing and usage process results in too much spillage or leakage.

It is generally desirable to overcome or ameliorate one or more of the above described difficulties, or to at least provide a useful alternative.

SUMMARY

In accordance with the present disclosure, there is provided a container assembly for containing freezable liquid, the container assembly comprising:

- a V-shaped container having a V-shaped cross-section and being formed from freezer-safe material; and
- a support base being shaped to receive and cooperate with the container thereby to support the container during filling with freezable liquid.

The support base may be shaped to receive and cooperate with the container, by having a V-shaped groove sized and shaped to receive the V-shaped container.

The support base may be formed from freezer-safe material and is adapted to be disposed in a freezer, with the container received in the V-shaped groove, during freezing of freezable liquid contained in the container.

The container may comprise:

- a body having the V-shaped cross-section; and
- a lid adapted to form a liquid-tight seal with the body when in a closed condition.

The lid may be attached to the body by a hinge. The lid may comprise one or more protrusions for gripping when manually moving the lid to an open condition. The lid may comprise a depressed surface surrounded by a peripheral, raised lip, the lip being adapted to engage the body of the container. The depressed surface may be adapted to receive a label, below the lip.

The body may comprise a raised rim adapted to engage the lid to form a liquid-tight seal with the lid.

The support base may comprise one or more laterally extending fins for increasing an external surface area of the support base.

The container may comprise one or more indicia corresponding with one or more corresponding indicia positionable on an outside of a freezer compartment, thereby to identify freezable liquid contained in the container without opening the freezer compartment. The indicia may comprise a colour of the container. The lid may be coloured so as to correspond with one or more corresponding indicia positionable on an outside of a freezer compartment, thereby to identify freezable liquid contained in the container without opening the freezer compartment. Thus the colour of the lid constitutes one index of the one or more indicia.

The support base may have a groove shaped to receive and cooperate with the V-shaped container. The container, when received in the groove (which may be V-shaped), may be slidable longitudinally along the groove thereby to enable the container to be removed from the support base.

The present disclosure further provides a freezer container support structure comprising:

- two or more plates; and
- at least two spaced support members,
- wherein the support members are adapted to engage the plates in spaced locations along the support members, to maintain one or more freezer containers between the plates during freezing of a freezable liquid contained in each said freezer container.

Each plate of the two or more plates may comprise a raised peripheral lip.

The support members may each comprise a strap for fitting around the two or more plates, thereby to maintain the two or more plates in register. The term "in register" is intended to include within its meaning that the plates are aligned—e.g. parallel and overlapping—or otherwise in a configuration to maintain the freezer containers therebetween.

The plates may have a substantially quadrilateral shape, the support structure comprising four said support members extending between the plates at or near respective corners of the plates.

The support members may each comprise one or more movable bearing members, the plates contacting the bearing members such that the bearing members maintain the plates in spaced relation. Each support member may be extendable so as to contact an upper internal surface and a lower internal surface of the freezer compartment, thereby to maintain the freezer container support structure in fixed position in the freezer compartment.

The plates may be movable with respect to the support members, such that plates can be added or removed from the freezer compartment to respectively increase or decrease space available for supporting freezer containers.

The present disclosure also provides a method for selectively accessing freezable liquid stored in a freezer compartment, the method comprising:

identifying, on an outside of the freezer compartment, one or more corresponding indicia corresponding to one or both of:

a storage period of freezable liquid stored in one or more freezer containers; and a selected volume of freezable liquid stored in the one or more freezer containers;

locating the one or more freezer containers inside the freezer compartment by locating one or more indicia inside the freezer compartment, the one or more indicia:

identifying the one or more freezer containers; and corresponding to the one or more corresponding indicia located on the outside of the freezer compartment; and removing the one or more freezer containers from the freezer compartment.

The method may further comprise removing the one or more corresponding indicia.

Locating the one or more freezer containers may comprise locating the one or more freezer containers on a plate of a freezer container support structure as described above, the method then further comprising removing said plate from the freezer container support structure.

The present disclosure still further provides a method for storing freezable liquid for future selective access, comprising:

dispensing freezable liquid into one or more freezer containers;

associating the one or more freezer containers with:

one or more indicia locatable in a freezer compartment, the one or more indicia:

identifying the one or more freezer containers; and corresponding to one or more corresponding indicia located on the outside of the freezer compartment;

wherein the one or more corresponding indicia identify one or both of:

a storage period of freezable liquid stored in one or more freezer containers; and a selected volume of freezable liquid stored in the one or more freezer containers;

positioning the one or more freezer containers in the freezer compartment; and sealing the freezer compartment.

When the term "for" is used in relation to the present container assembly, freezer container support structure and method for containing/storing freezable liquid, that term will be understood to mean "suitable for but not limited to". The freezable liquid may be breast milk, but insofar as being 'suitable for but not limited to' use with freezable liquid, the present container assembly, support structure and method may also be used with food stuff (e.g. minced meat, crushed fruits and/or vegetables, frozen meals (solid or liquid) and the like).

Positioning the one or more freezer containers in the freezer compartment may comprise positioning the one or more freezer containers on a plate of a freezer container support structure as described above, the method further comprising adding a further plate to the freezer container support structure in spaced relation to said two or more plates of the freezer container support structure.

The present container may be formed from silicon.

Embodiments of the present invention may enable reuse of freezer containers and/or may provide an indication of which freezable liquid, stored in freezer containers in a freezer compartment, should be first used and the volume of freezable liquid in each said container and the volume remaining in the freezer compartment.

BRIEF DESCRIPTION OF THE DRAWINGS

Preferred embodiments of the invention are hereafter described, by way of non-limiting example only, with reference to the accompanying drawings, in which.

DETAILED DESCRIPTION OF PREFERRED EMBODIMENTS

Embodiments of the present invention enable the storage and use of freezable liquids in a selective and organised manner. The freezable liquids can thus be used based on the age of the liquid (e.g. the period of time the liquid has been stored in a freezer compartment) or the volume of liquid in a freezer container.

Unless context dictates otherwise, the term "freezable liquids" and similar terms will be taken include liquids that are liquid at room temperature, but freeze to a solid when left in a freezer compartment—e.g. the freezer compartment of a domestic refrigerator. Thus, the term "freezable liquids" and similar terms will also include within their scope such liquids when frozen (i.e. frozen solid).

The present discussion will generally refer to the use of the present apparatuses and methods with human breastmilk. However, it may be possible to use the present apparatuses and methods with other freezable liquids.

Figure 1A:
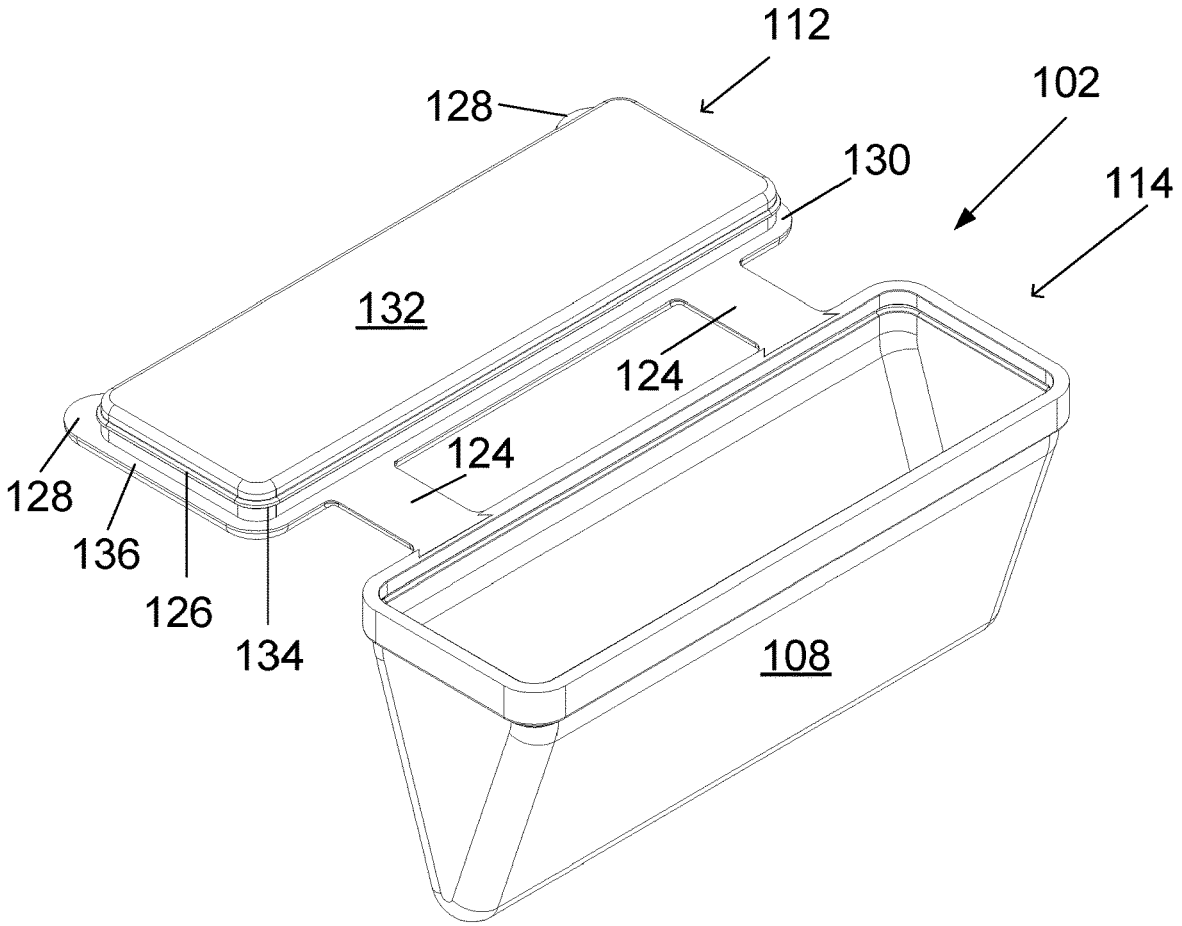
FIGS. 1*a*, 1*c* and 1*d* show top perspective, top and side views respectively, of a freezer container in accordance with present teachings, in an open condition.
Figure 1B:
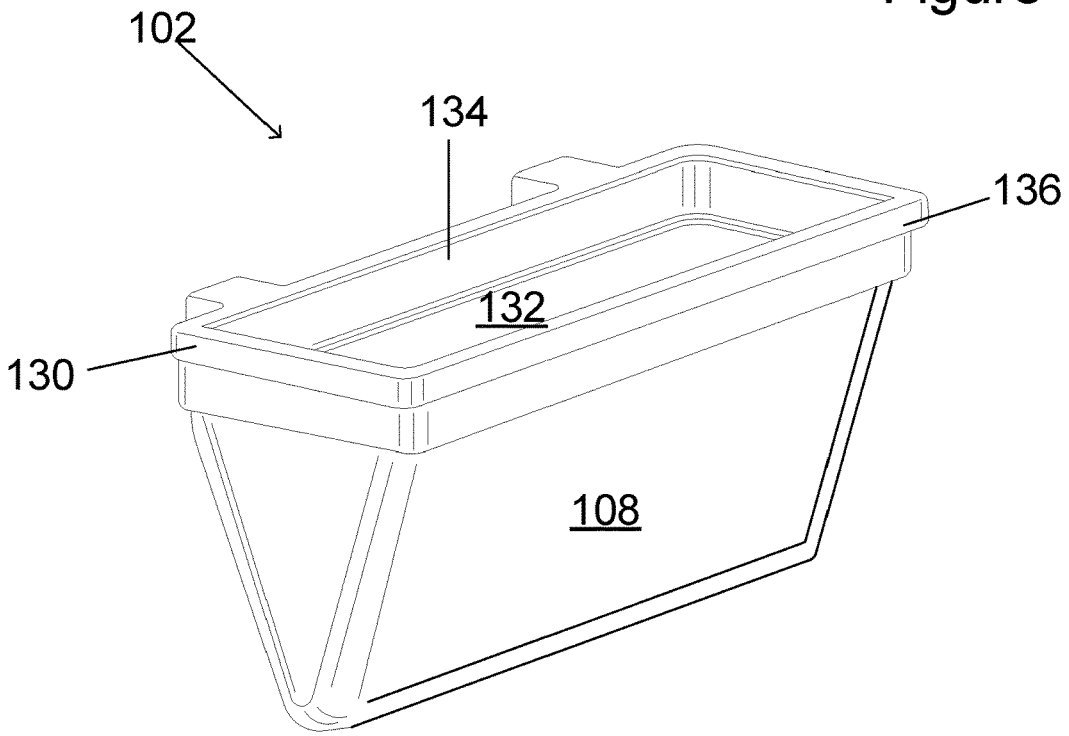
FIG. 1*b* shows a top perspective view of a freezer container in accordance with present teachings, in a closed condition.
Figure 1C:
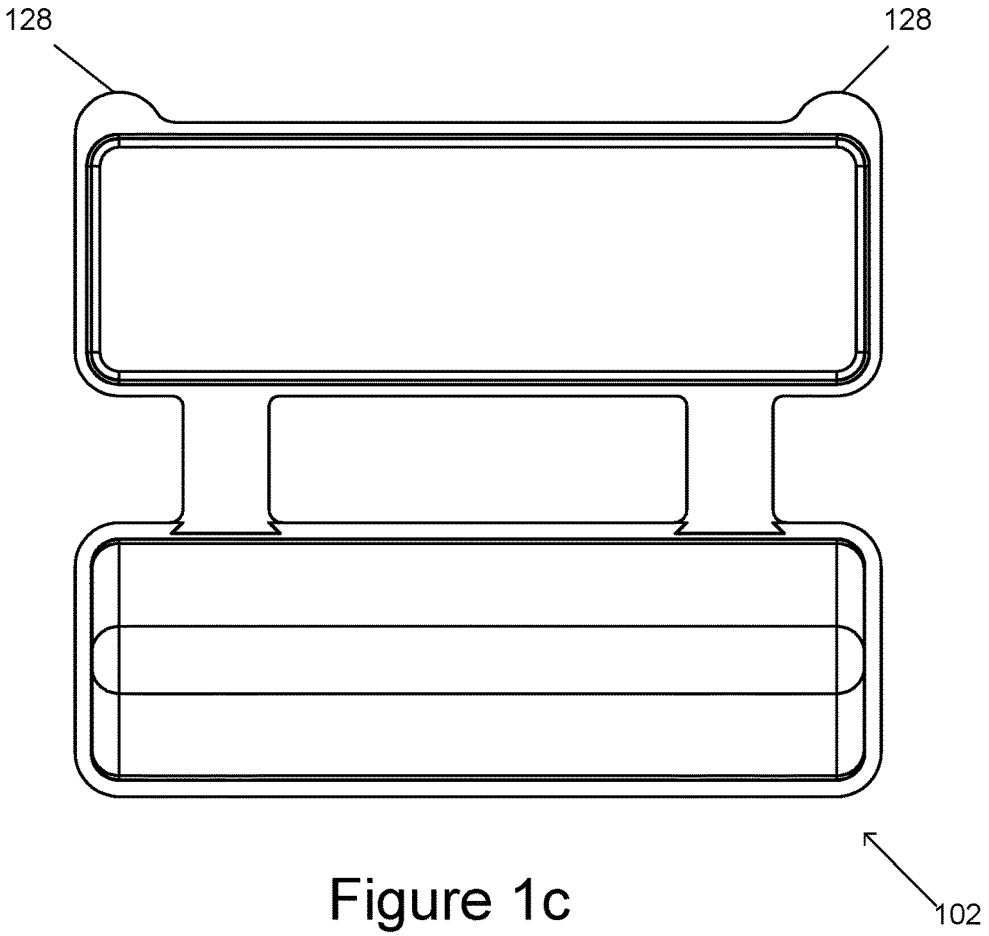
Figure 1D:
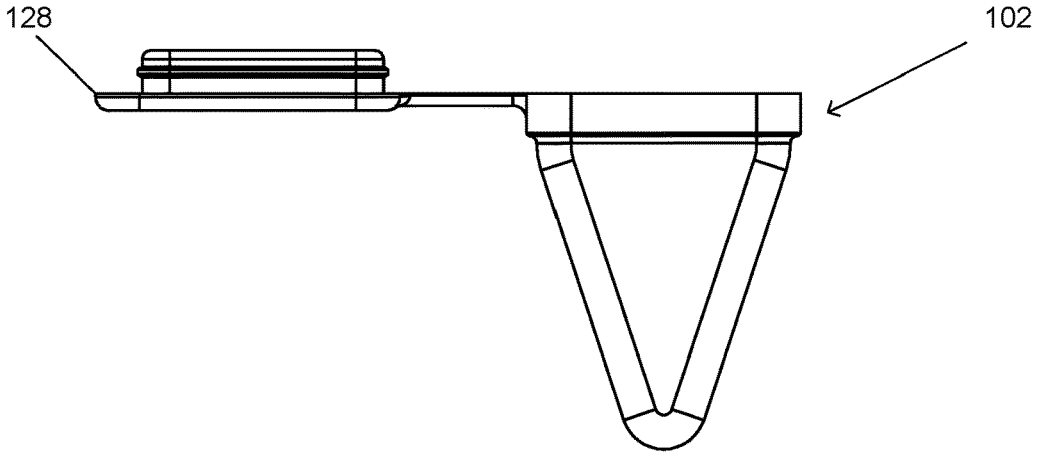
Figure 2:
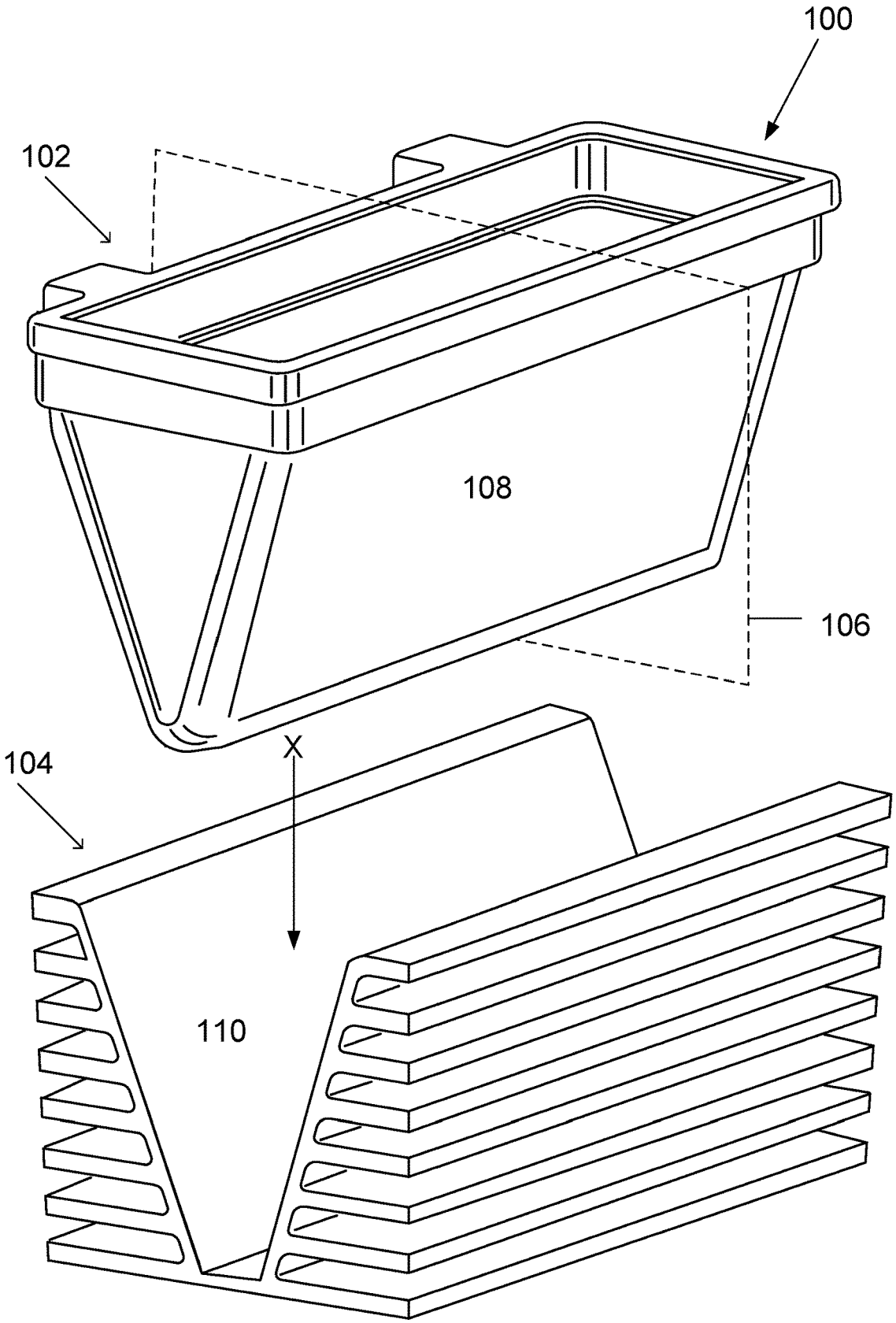
FIG. 2 shows the freezer container of FIG. 1*b* in position for receipt in a support base in accordance with present teachings.
Figure 3:
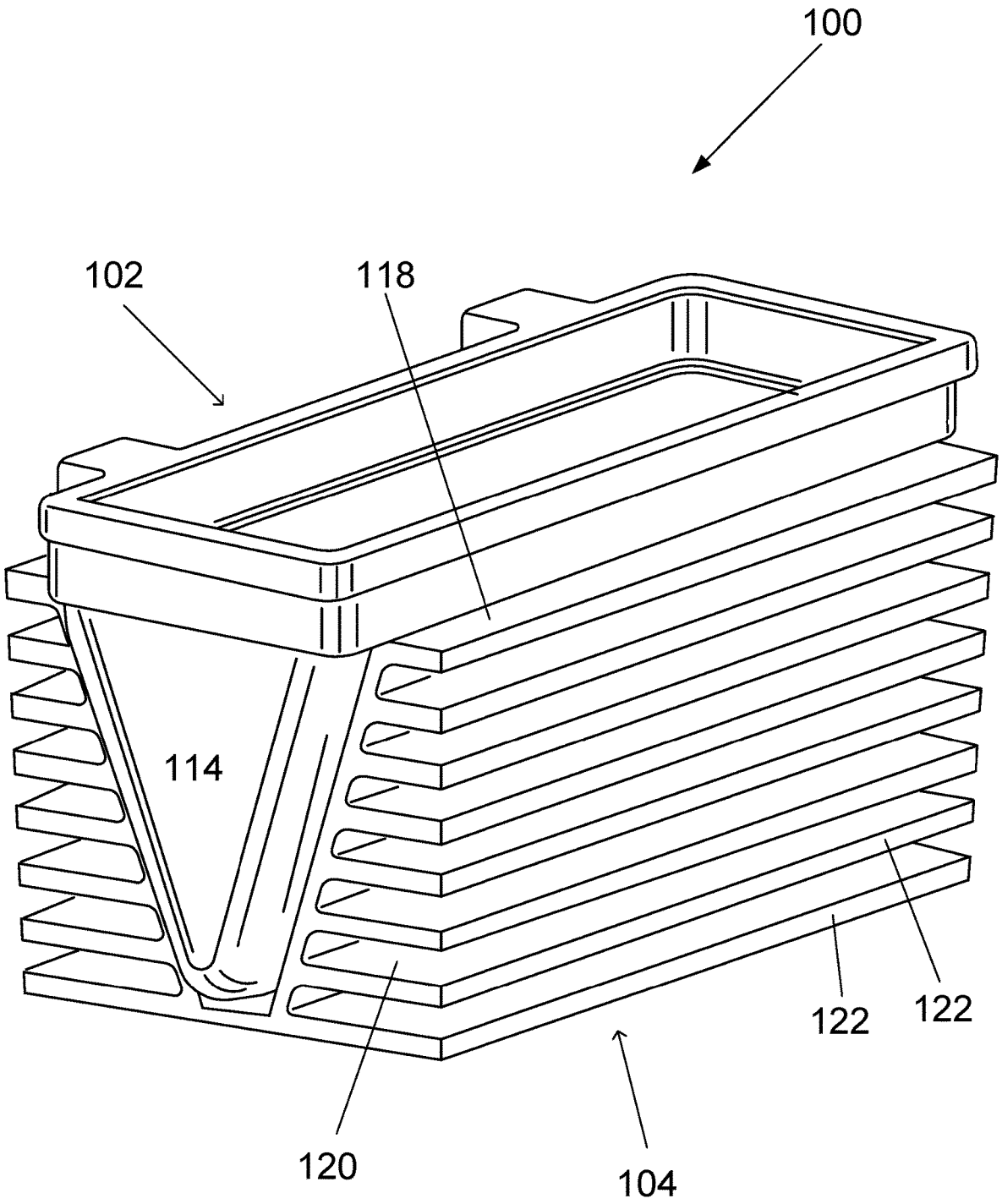
FIG. 3 shows the freezer container of FIG. 1*b* in position in the support base.

FIGS. 2 and 3 illustrate a container assembly 100 for containing freezable liquid. The container assembly 100 includes a V-shaped container 102 and a support base 104. The container assembly 100 enables breastmilk (or other freezable liquid) to be stored in freezer containers, such as container 102, and is adapted to be located in a freezer during freezing of the freezable liquid.

The freezer container 102 and support base 104 are shaped to cooperate such that the support base 104 receives and supports the container 102 during filling of the container 102 with freezable liquid. Presently, the container 102 has a V-shaped cross-section (e.g. taken through plane 106) and the support base 104 has a V-shaped groove sized to receive the container 102, though other cross-sections (e.g. rectangular) may be used in some cases. An outer surface 108 of the container 102 is therefore adapted to cooperate or conform to an inner surface 110 of the support base 104.

The V-shaped groove defined by surface 110 is open at at least one end, and presently at both ends. This enables the container 102, when received in the V-shaped groove 110, to slide longitudinally (i.e. in a direction perpendicular to the V-shaped cross-section, or plane 106) along the V-shaped groove 110. Thus the container 102 can be removed from the support base 104 without having to lift the container by its lid 112.

FIG. 2 shows the container 102 in a position for receipt in support base 104, in the direction of arrow X. FIG. 3 shows the container 102, when received in the support base 104. As mentioned above, the container 102 comprises a lid 112. The container 102 further comprises a body 114 and the lid 112 forms a liquid-tight seal with the body 114 when in a closed condition as shown in FIGS. 2 and 3.

The body 114 comprises the surface 108 that defines the V-shaped cross-section, and also comprises a raised rim 116. The raised rim 116 projects outwardly from the surface 108 such that it rests on an upper surface 118 of the support base 104 when the container 102 is received therein. The raised rim 116 therefore supports the container 102 on the support base 104 during filling of the container 102 with breastmilk. In addition, the rim 116 projects over the interface between surface 108 and surface 110. The rim 116 therefore reduces the likelihood of breastmilk seeping in between the container 102 and support base 104, which may otherwise attach the container 102 to the support base 104 if the container 102 remains in the support base 104 during freezing of the breastmilk.

The support base 104 includes the internal surface 110 as described with reference to FIG. 2 (i.e. the surface shaped to conform to the V-shaped cross-section of the container 102, or the container 102 as a whole). In addition, the support base 104 includes an external surface 120, being that which is not adapted to contact the container 102 during filling of the container 102.

While the external surface 120 may take any desired shape, the present external surface 120 comprises a plurality of laterally extending fins 122. The fins 122 project in equal number, in opposite directions, of the support base 104. The fins 122 extend parallel to a longitudinal direction of the container 102, namely perpendicular to the V-shaped cross-section thereof.

The fins 122 are intended to increase the surface area of the support base 104 to facilitate more rapid cooling. Heat from the breastmilk in the container 102 transfers to the container 102, and from the container 102 into the support base 104. The support base 104 then transfers that heat into the environment in the freezer compartment during freezing of the breastmilk. Having increased surface area through which heat can be transferred may thus increase the rate of cooling.

It will be understood that no fins, one fin or any other number of fins may be provided, as desired.

The container 102 and support base 104 are formed from freezer-safe material (i.e. material that does not degrade or otherwise perish in a freezer compartment). The container 102 and base 104 may, for example, be formed from silicon. The base 104 may instead be formed from metal. Thus the support base 104 is adapted to be disposed in a freezer compartment, with the container 102 received in the V-shaped groove defined by surface 110, during freezing of freezable liquid contained in the container 102.

Now referring to FIGS. 1*a* to 1*d*. The lid 112 of the container 102 is attached to the body 114 by a hinge 124, although any other connection system may be used or connection between the two may simply be achieved on the lid 112 being press-fit or friction-fit onto the body 114. The hinge 124 may be a living hinge (e.g. integral with the lid 112 and body 114 and formed by a thinning of material such that bending preferentially occurs through that material instead of the lid 112 or body 114) or any other suitable hinge mechanism.

The lid 112 comprises one or more protrusions 128 for gripping when manually moving the lid 112 to an open condition. The protrusions 128 are presently formed as a pair of semicircular extensions of a raised lip 130 that extends around a periphery of the lid 112. Any other form of grip may be used as appropriate.

The present lip 130 includes an extension 134 and a flange 136. The flange 136 seats on top of the body 114 when the lid 112 is pushed into a closed condition against the body 114. The lid 112 further comprises a depressed surface 132 surrounded by the peripheral, raised lip 130. The extension 134 of the lip 130 extends between the depressed surface 132 and the flange 136.

The lip 130 is adapted to engage the body 114 of the container 102 when the container 112 is in a closed condition. Engagement may simply comprise the provision of a friction fit between the lid 112 and body 114—for example, the extension 134 may be slightly larger than an internal surface 138 of the body 114, e.g. an internal surface 138 of the rim 116, such that friction maintains the lid 112 in position on the body 114. Instead, the present lip 112 comprises a sealing ring 126. The sealing ring 126 extends around the outside of the extension 134 and seals against the body 114 in an understood manner. Thus the raised rim 116 of the body 114 facilitates formation of a liquid-tight seal with the body 112.

The container assembly 100 operates with a related series of indicia. The indicia enable a user to identify which freezer container 102 to use—e.g. based on age of breastmilk and/or volume in the respective container—from a plurality of freezer containers contained in a freezer compartment, without having to open the freezer compartment. To this end, the container 102 comprises one or more indicia corresponding with one or more corresponding indicia positionable on an outside of the freezer compartment (see reference 140 in FIGS. 4 and 6). The outside may comprise the door of a freezer, a bench beside the freezer or elsewhere.

Figure 4:
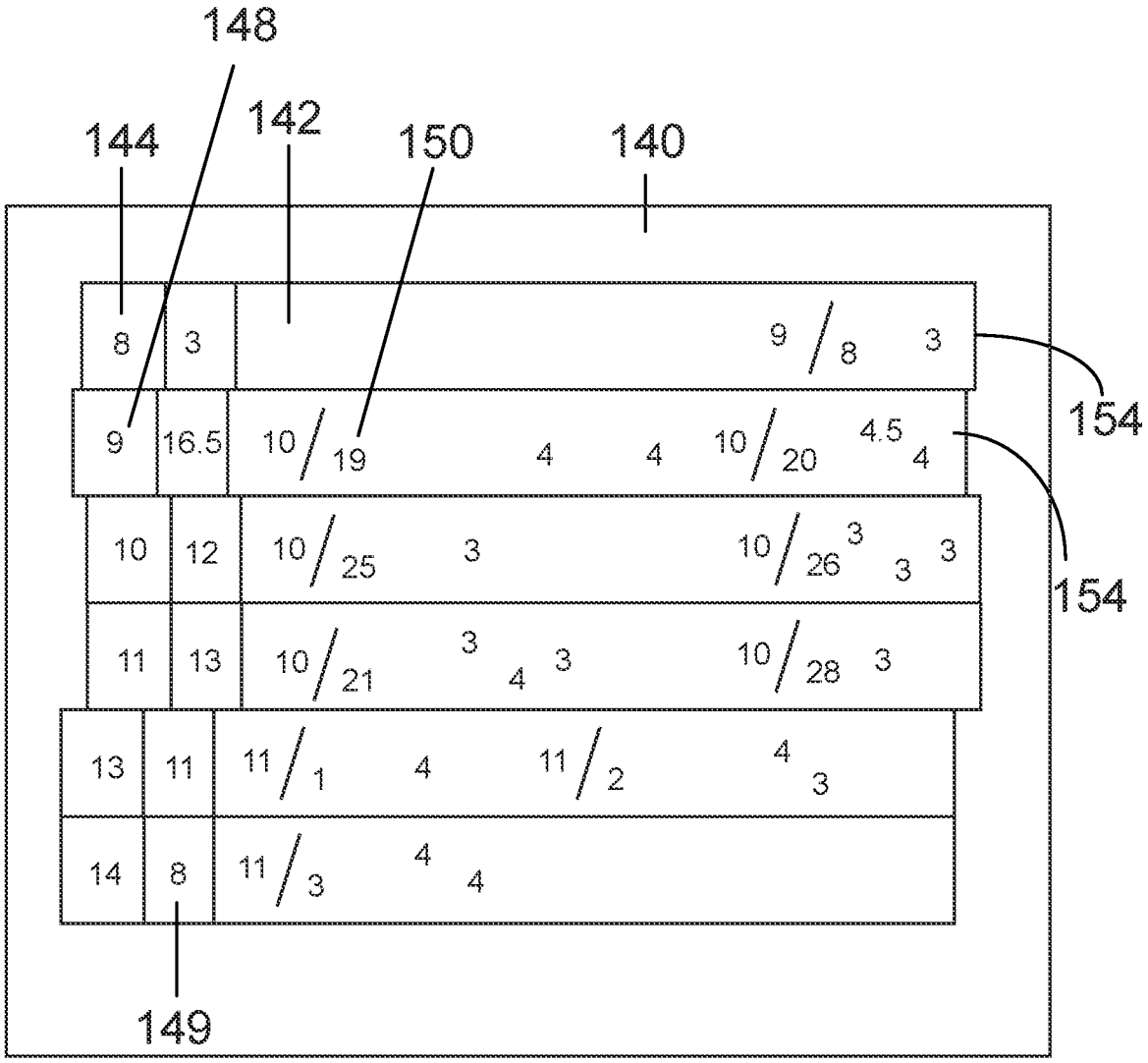
FIGS. 4 and 6 show a set of fridge magnets bearing corresponding indicia, the corresponding indicia corresponding to indicia associated with one or more freezer contains located inside a freezer compartment.
Figure 6:
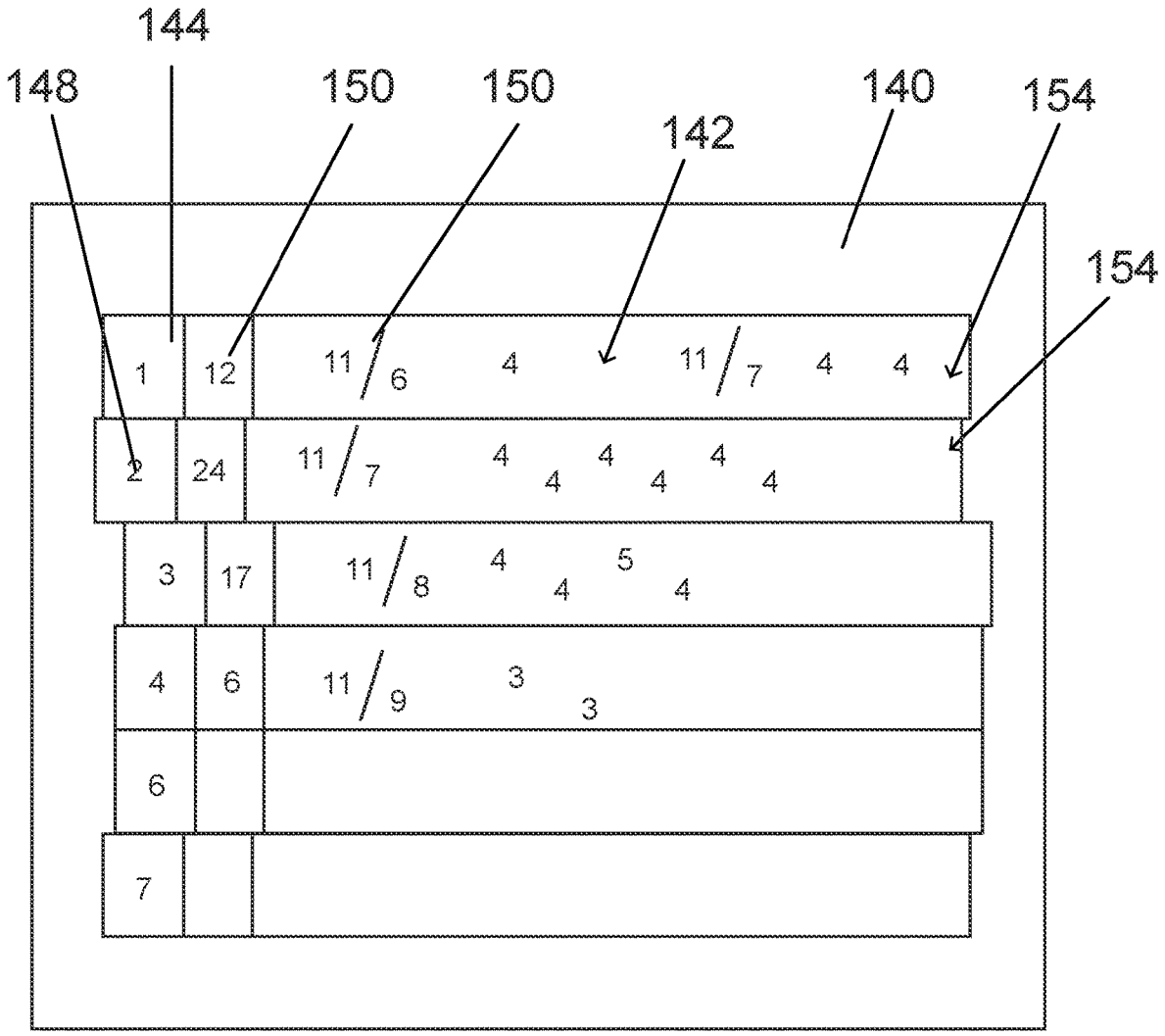

FIGS. 4 and 6 show examples of indicia. The indicia 142 comprise a colour code. The colour code 144, shown in relation to indicia 142, correspond to a colour code associated with one or more containers, such as containers 102, located in the freezer compartment. In some embodiments, the colour code may correspond to a colour of the container itself—e.g. the container may be made of silicon dyed red, and corresponding to a red-coloured label on the outside of the freezer compartment.

Rather than colouring the entire container, the lid, such as lid 112, may be coloured so as to correspond with one or more corresponding coloured indicia on the outside of a freezer compartment. Thus a user may identify freezable liquid contained in the container without opening the freezer compartment.

The indicia may instead employ pairs of characters—e.g. numbers, letters, symbols or other visual device—with one in each pair being located on the outside of the freezer compartment, and the other one in each pair being located inside the freezer compartment in association with the corresponding one or more containers.

Notably, the indicia shown in FIGS. 4 and 6 are provided on a series of fridge magnets 154. Each magnet 154 provides a colour code that may correspond to a coloured tag attached to a container in the freezer compartment—such as coloured tags 146 in FIG. 5. Each magnet 154 also provides a number 148 which may correspond with a number provided on each relevant container, or the containers may be located on trays, discussed with reference to FIG. 7, on which the numbers are located. Each magnet 154 further lists a volume 149 of breastmilk in each container, and a date 150 on which that breastmilk was expressed and put into the container. The volume and date written on each fridge magnet 154 could be written in dry erase solution so that the indicia wipe easily from the magnet 154 once the corresponding one or more containers have been used.

In some embodiments, the depressed surface 132 is adapted to receive a label, below the lip 130. In this context, the phrase "below the lip" is intended to mean below the flange 136 of the lip 130 so that a label displaying indicia can be positioned on the depressed surface 132 and will be readily visible while the surrounding lip 130 protects the label from coming into contact with other objects in the freezer compartment. Thus the label may remain readable for longer than if it were not protected.

By using a V-shaped container 102 rather than, for example, a cube or box shape, results in fewer edges between planar surfaces of the body 114. Having fewer edges potentially results in fewer sites where bubbles can be trapped which may otherwise contaminate breastmilk in the container 102. In addition, when inserting and removing the container 102 parallel to the direction of arrow X, there are no side of the container 102 that are parallel to that direction of insertion/removal. Accordingly, there is very little friction when removing a filled container, thus potentially reducing the force required to remove the container and consequentially reducing the risk of spillage of breastmilk.

Figure 5:
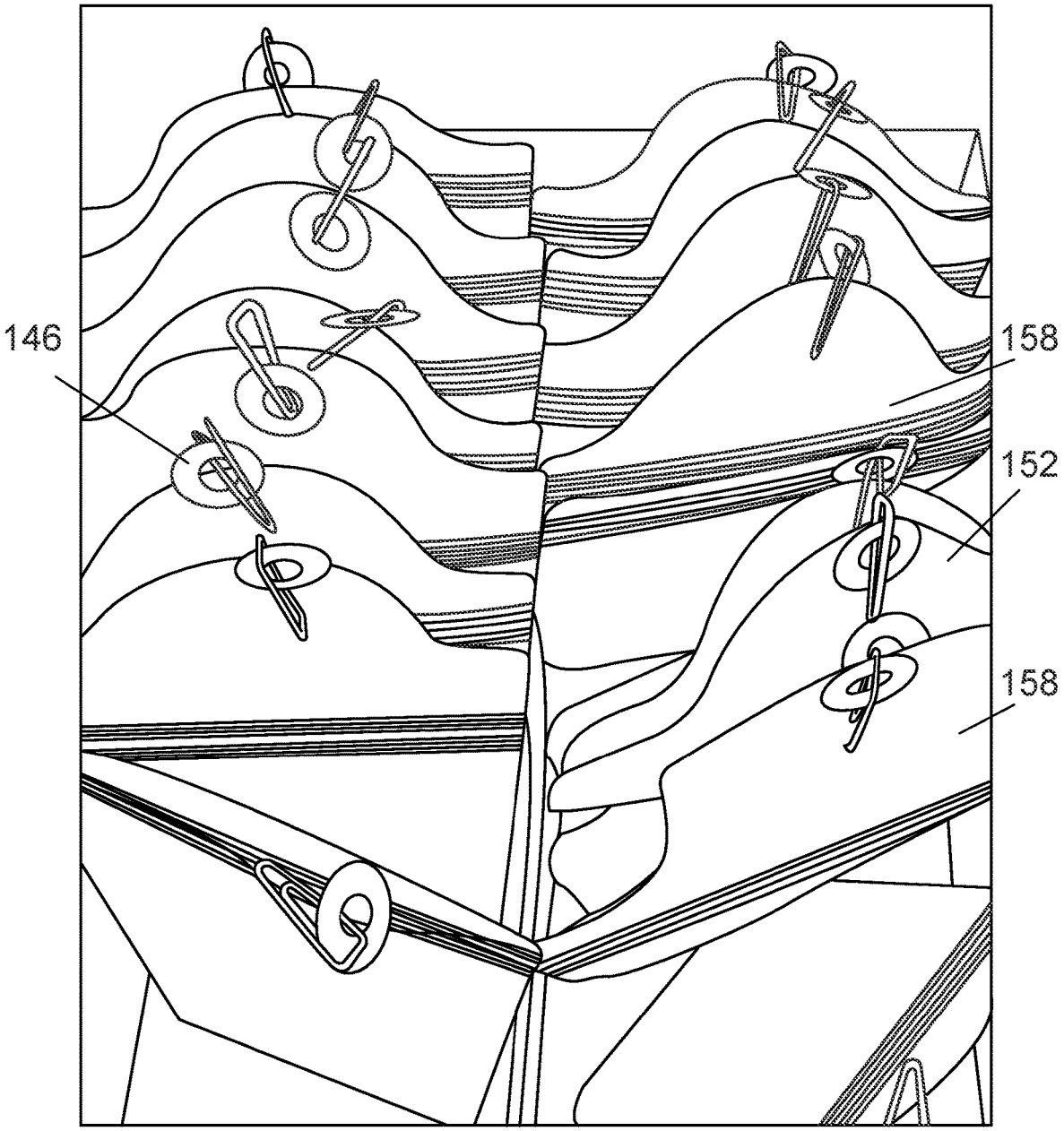
FIG. 5 is a photo of a plurality of freezer containers, each comprising a bag, and indicia, located in a tray in a freezer compartment.

FIG. 5 shows an alternative container, comprising a bag 152. A coloured tag 146 is attached to each bag 152, by a clip or pin. The tags may be attached by any other method, or may be incorporated into the bag 152 itself. Each bag 152 shown in FIG. 5 also comprises a label 158. The volume of breastmilk in each bag 152 is listed on the respective label 158. Notably, the breastmilk frozen in the bags 152 has frozen in a substantially flat shape. Normally, if liquid is frozen in a bag it will collect and form a bulge in the base of the bag. Bulging bags are less desirable than flat bags since they occupy more space in a freezer compartment and take longer to freeze and defrost or thaw, due to lower surface area per unit volume when compared with breastmilk frozen in flat bags.

Figure 7:
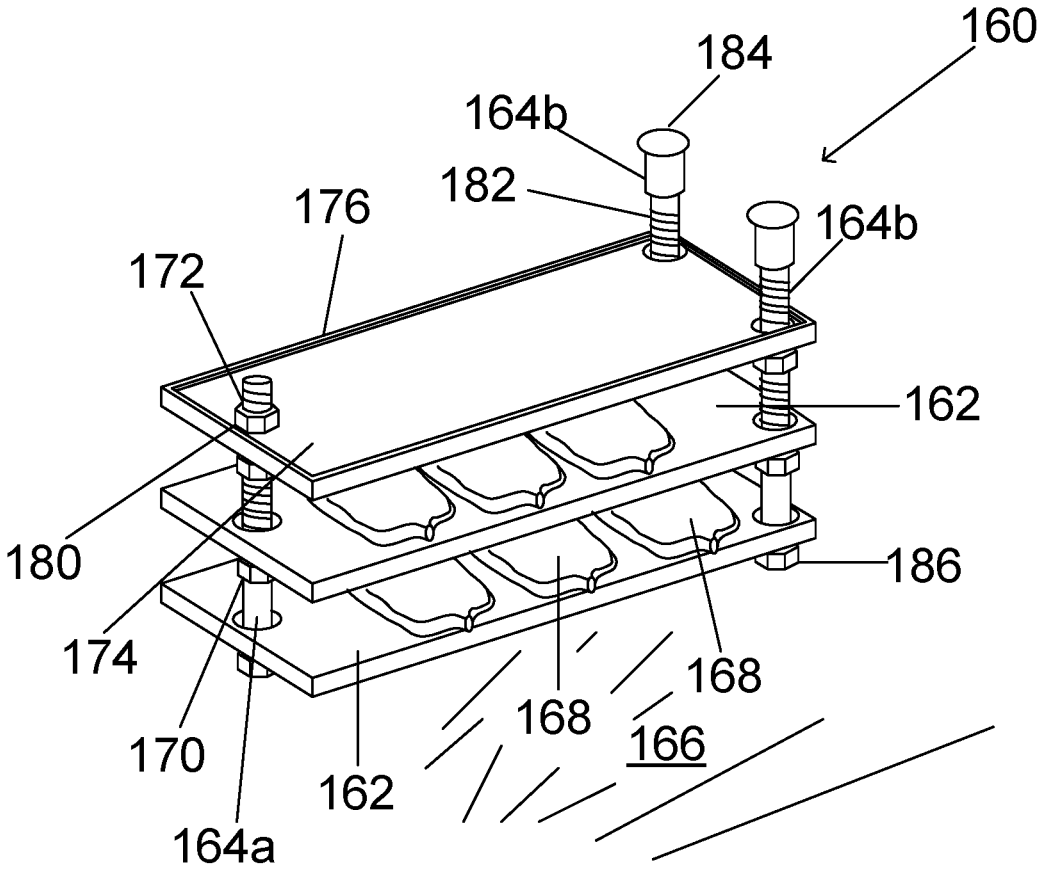
FIG. 7 is an illustration of a freezer container support structure in accordance with present teachings.

In an alternative liquid storage scenario, a freezer container support structure 160 is provided, as shown in FIG. 7. The freezer container support structure 160 comprises two or more, and presently three, plates 162. The freezer container support structure 160 also includes at least two spaced support members 164*a*, 164*b*. The support members 164*a*, 164*b* are adapted to engage the plates 162 in spaced locations along the support members 164*a*, 164*b*, to maintain one or more freezer containers between the plates during freezing of a freezable liquid contained in each said freezer container. The spaced locations may be discrete locations along the support members 164*a*, 164*b*, or may be locations in a continuous range of possible locations along the support members 164*a*, 164*b*.

In some embodiments, particularly that as shown in FIG. 7 in which the support members are rigid, the plates 162 may be maintained in spaced relation, parallel to a surface 166 of a freezer compartment when the support structure 160 is positioned in the freezer compartment. This ensures freezer containers, such as bags, positioned on respective ones of the plates 162 do not slide off while in the freezer compartment. Each of the plates 162 is adapted to support one or more freezer containers 168 during freezing of a freezable liquid contained in each said freezer container 168.

For illustration purposes only, the structure 160 is shown with a single support member 164*a* at one end, and two support members 164*b* at the opposite end. In practice, the number of support members at either end will likely be the same. Presently, the plates 162 are each substantially quadrilateral in shape, particularly rectangular, and the support structure 160 would thus typically include four support members, each extending between the plates 162 at respective corners of the plates. In this sense, "substantially quadrilateral" means having four generally straight sides. However, this terminology is intended to include within its scope embodiments where the corners are rounded, a peripheral lip or rim projects out of plane with the main body of the plate 162 and so forth.

Each support member 164*a*, 164*b* comprises one or more movable bearing members, presently embodied by seats 170. The plates 162 contact the bearing members such that the bearing members maintain the plates 162 in spaced relation in the freezer compartment. As particularly shown with respect to the single support member 164*a*, the bearing members comprise seats 170 on which the plates rest in an understood manner. Each seat 170 may be a nut or any other device for movable attachment to the support member 164*a*, so as to be capable of accommodating freezer containers 168 of different volume or thickness. Presently, the seats 170 are nuts with an internal screw thread that engages a corresponding screw thread on a shaft 172 of the respective support member 164*a*. The same arrangement applies with support members 164*b*.

In other embodiments, a further bearing member 180 such as a nut may be moved down the shaft 172 on top of each plate (except the bottom plate) to press the respective plate down upon the freezer containers 168 on the plate immediately below. This may assist in ensuring the freezer containers 168 freeze flat and take up minimal room. In further embodiments, only the further bearing member is provided.

Support member 164*b* comprise a shaft 182 and upper foot 184. The upper foot 184 includes an internal thread in the same manner as a nut, and is rotatable about the shaft 182 to raised or lower the upper foot 184 on the shaft 182. Thus, the support members 164*b* are extendable so as to contact an upper internal surface and a lower internal surface (by lower foot 186—on which the lowermost plate 162 may rest in use) of the freezer compartment. This assists with maintaining the freezer container support structure 160 in fixed position in the freezer compartment in the event that it is knocked while other items are being inserted into or removed from the freezer compartment or the support structure 160 itself.

The top plate 174 comprises a raised peripheral lip 176. Such a lip 176 may be provided on all plates. The lip 176 prevents the freezer containers 168 from sliding off the plates 162 while in the freezer compartment. The lip 176 may extend the entire way around the periphery of the relevant plate(s), or may extend around the full periphery of some plates and not others. The lip 176 may extend around three of four sides of each plate 162, so as to leave one side free from obstruction for insertion of a freezer container onto that plate and subsequent removal of that container. Also, each plate 162 may be designed to carry multiple freezer containers, side-by-side across the plate and/or stacked atop one another on the plate, or only a single freezer container, depending on the size of the plates and the volumes of the containers.

By providing seats 170 and/or bearing members 180, the plates are movable with respect to the support members 164*a*, 164*b*. Thus plates 162 can be added or removed from the freezer compartment to respectively increase or decrease space available in the support structure 160 for supporting freezer containers 168. In this sense, while freezer containers 168 can be stacked directly atop neighbouring freezer containers 168, the stack may become unstable. The addition of further plates 162 on the support members 164*a*, 164*b* provides additional metal surfaces onto which further freezer containers 168 may be placed for freezing, without destabilising the any other freezer containers 168 already in the support structure 160.

Figure 9:
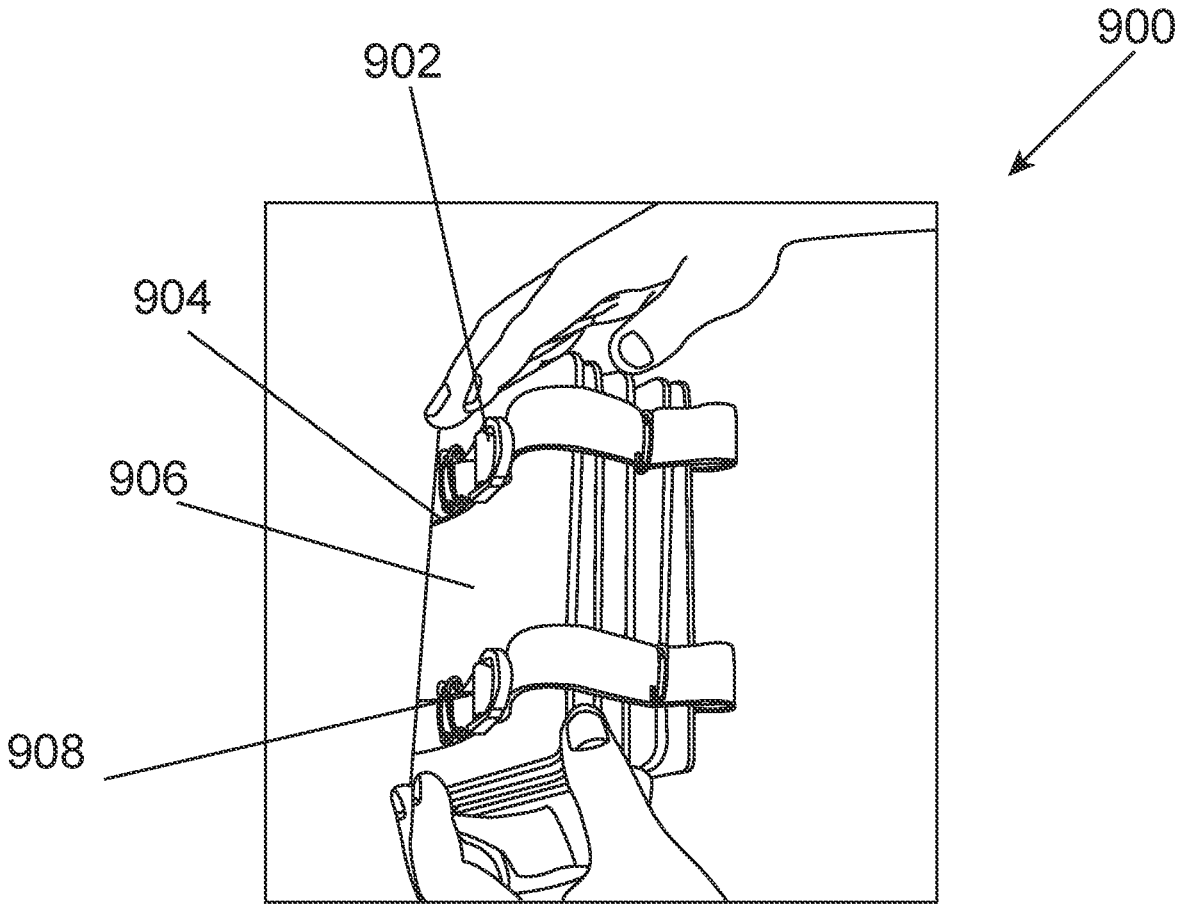
FIG. 9 is a photo of another embodiment of a freezer container support structure.

Another embodiment of a freezer container support structure 900 is shown in FIG. 9, in which straps 902 are inserted into notches 904 in the plates 906. Freezer container(s) (e.g. bags) are positioned between the plates 906 and the straps 902 are then inserted into the notches 904. The straps 902 are tightened to reduce the size of the loop extending from and return to buckles 908. This holds the freezer container(s) between the plates 906. The straps 902 may be elasticised to assist with removal of the straps 902 when it is desired that a freezer container be accessed, and to reduce load concentrations on the freezer containers. In the elasticized case, the straps may or may not require a buckle. Given each strap 902 in the present embodiment forms a loop around the plates 906, the straps 902 each provide two support members, being those portions of each strap extending between the plates 906.

Using the apparatuses of FIGS. 1 to 7, methods may be employed for selectively accessing freezable liquid stored in a freezer compartment. Such a method would include identifying, on an outside (i.e. external side in the ambient environment around the freezer compartment, as opposed to an inside of the freezer compartment that defines the chilled volume of the freezer compartment) of the freezer compartment, one or more corresponding indicia. As mentioned above, the indicia associated with freezer containers inside the freezer compartment—such as colours, symbols etc—correspond with corresponding indicia on the outside of the freezer compartment so that a user may know which container to remove from the freezer compartment, without having to open the freezer compartment. Notably, the indicia being located on an outside of the freezer compartment may comprise physically being located on an external surface of the freezer compartment, but may also include being located elsewhere outside the freezer compartment, such as on a bench near the freezer compartment.

The corresponding indicia indicate one or both of a storage period of freezable liquid stored in one or more freezer containers associated with the relevant indicia within the freezer compartment, and a selected volume of freezable liquid stored in the one or more freezer containers. Notably, the storage period may not be identified in terms of days, weeks etc, but may instead be identified in terms of first in or oldest to youngest. This can be achieved by moving fridge magnets into a list ordered by age of breastmilk.

In addition, the selected volume may be an actual volume (e.g. 100 mL, 2 fluid ounces etc) or may be relative (e.g. a single feed, one third of a single feed, etc).

After identifying the desired corresponding indicia, the method comprises locating the relevant one or more freezer containers inside the freezer compartment. This is done by locating one or more indicia inside the freezer compartment, where the one or more indicia both identify the one or more freezer containers, and correspond to the one or more corresponding indicia located on the outside of the freezer compartment. With regard to the embodiment shown in FIG. 7, this may involve locating the one or more freezer containers on a plate 162 of a freezer container support structure 160. Moreover, if the freezer container is the last on that plate of the freezer container support structure or, in total, there is sufficient spare room in the freezer container support structure to remove a plate 162, then the method may involve removing that plate so as to reduce the volume occupied by the freezer container support structure, or to make some freezer containers more easily accessible in the freezer container support structure.

Once the relevant one or more containers have been located, the one or more freezer containers are removed from the freezer compartment. If the freezer containers or indicia are reused, the one or more corresponding indicia should be removed—e.g. erased from the fridge magnets—after the relevant one or more containers are removed from the freezer compartment. This will reduce the likelihood of errors once the containers and/or indicia are reused with new breastmilk.

Similarly, to store freezable liquid for future selective access requires dispensing freezable liquid into one or more freezer containers. Dispensing may involve pumping breastmilk into a receptacle and pouring the pumped breastmilk from the receptacle into one or more freezer containers, or directly pumping into the one or more freezer containers.

After the one or more containers are filled to the desired level, they are associated with one or more indicia locatable in a freezer compartment. The indicia, as mentioned above, may comprise colour coding of the containers themselves, or the attachment of labels or tags to the containers. The one or more indicia thereby identify the one or more freezer containers and also correspond to one or more corresponding indicia located on the outside of the freezer compartment. The corresponding indicia may be colour codes and/or written indicia as discussed with reference to FIGS. 4 and 6. The one or more corresponding indicia thus identify to a user, without having to open the freezer compartment, a storage period of freezable liquid stored in the one or more freezer containers and/or a selected volume of freezable liquid stored in the one or more freezer containers.

The one or more freezer containers are then positioned in the freezer compartment and the freezer compartment is sealed to commence freezing the freezable liquid. With regard to the support structure 160 of FIG. 7, positioning the one or more freezer containers in the freezer compartment may involve positioning the one or more freezer containers on a plate of the freezer container support structure 160. When desired, a further plate 162 may be added to the freezer container support structure 160 in spaced relation to the plates already located in the freezer container support structure. Thus, the capacity of the freezer container support structure can be increased to facilitate addition of further freezer containers into the freezer compartment. The plate may also, or alternatively, bear down on the unfrozen contents of freezer containers on the plate immediately below, thereby assisting with ensure the freezable liquid freezes relatively flat and thus occupies little room in the freezer.

Figure 8A:
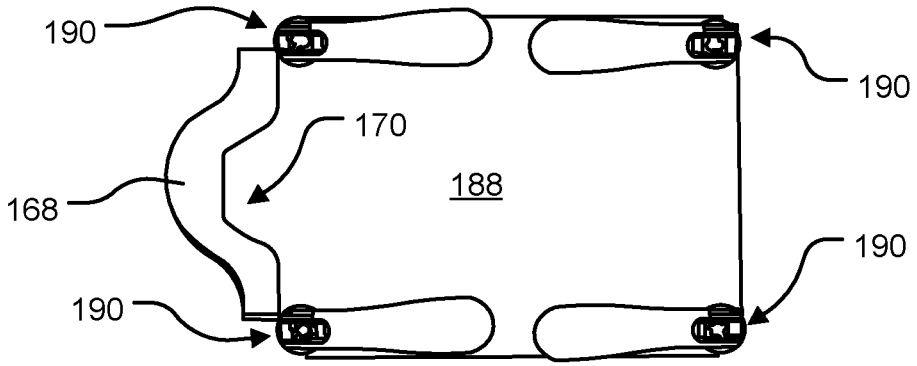
FIG. 8 is an illustration of an alternative embodiment of a freezer container support structure in accordance with present teachings.
Figure 8B:
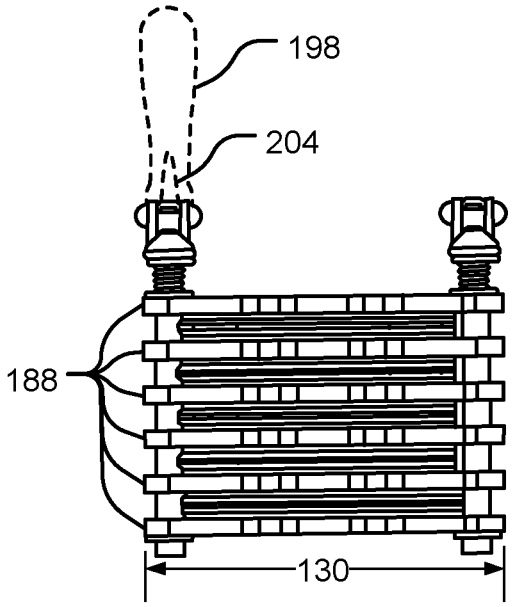
Figure 8C:
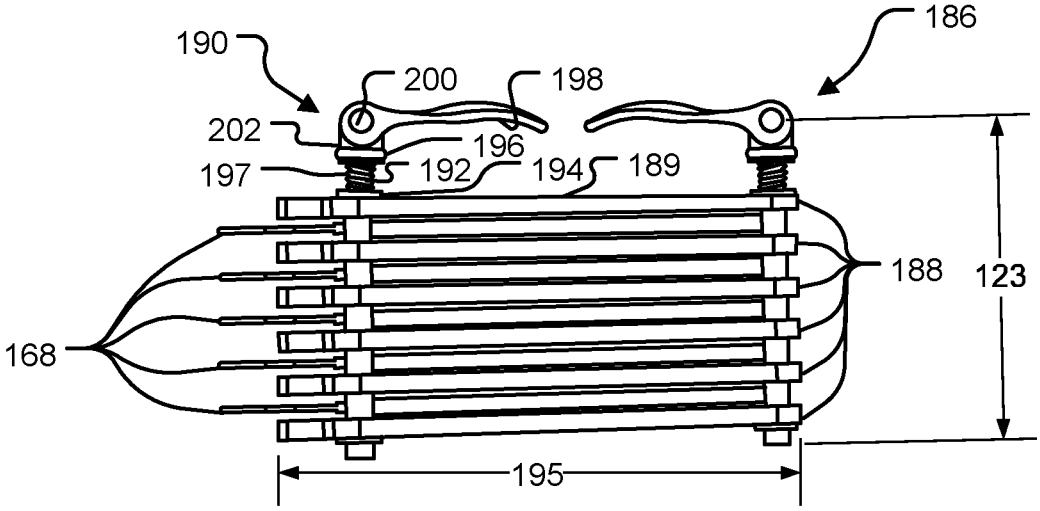

An alternative support structure 186 is shown in FIG. 8, comprising FIGS. 8A, 8B and 8C. FIG. 8A shown a top view of the structure 186. A generally rectangular plate 188 is provided, with a lip 190 for grasping the plate 188. FIG. 8 shows a stack of such plates 188 sized to generally conform with the peripheral dimensions of a single freezer container or freezer bag 168 of predetermined shape and/or volume.

While generally conforming to the size and shape of a predetermined freezer container 168, to facilitate easy withdrawal of a freezer container 168 from the support structure 186 the plates 188 are slightly smaller than the freezer containers 168 in at least one dimension. Thus, as shown in FIGS. 8A and 8C, the freezer containers 168 overhang the plates 188 and can thus be grasped from, for example, the middle of the stack of plates 188 without undue difficulty.

Instead of telescopic support members 164*a*, 164*b*, the support structure 186 comprises sprung, quick release tension supports 190. Each sprung support 190 comprises a skewer 192, which is an elongate threaded shaft, a bearer plate 194 and a release plate 196 separated by a spring 197, and a release handle 198. In use, the handle 198 (at this stage angled upwardly as shown in broken lines in FIG. 8B) is rotated, with the release plate 196 until the bearer plate 194 bears against the top plate 189 and the spring 197 thus experiences a small amount of compression. The handle 198 is then rotated about pin 200 to place further compression on the release plate 196, through the spring 197 onto the bearer plate 194 and thus onto the top plate 189.

The handle 198 achieves compression as it has non-uniform thickness around the eye of the handle 198 surrounding the pin 200. Thus, in the release condition shown in FIG. 8B, a thin portion of the eye is between the pin 200 and release plate 196. Conversely, when the handle 198 is in the compression condition shown in FIG. 8C, a thicker portion of the eye is between the pin 200 and release plate 196. Since the handle 198 is in fixed position on the skewer 192, as a result of the mating screw thread in the mount 202 to which the handle 198 is attached, the release plate 196 is pushed downwardly. This increases compression in the spring 197 and therefore the downward force applied to the bearer plate 194.

Since top plate 189 presses against the stack of plates 188 and freezer containers 168 thereby ensuring the freezer containers 168 freeze flat and remain held within the structure 186. When removing a freezer container 168 from the stack, rather than needing to take the time to unscrew the release plate 196, the quick release handle 198 can be moved to its release condition as shown in FIG. 8B. Since the contents of the freezer containers 168 will be frozen solid at this stage, release of the handle 198 will release much or all of the compression. A freezer container 168 can then be selected and removed from the support structure 186.

The handle 198 include a slot 204. This slot 204 enables the skewer 192 to pass through the handle when the handle is applying compression to smaller stacks plates 188.

Many modifications will be apparent to those skilled in the art without departing from the scope of the present invention Throughout this specification, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that the prior art forms part of the common general knowledge.

The invention claimed is:

1. A freezer container support structure comprising:

two or more plates; and straps that fit around the plates in spaced locations to compress one or more freezer containers between the plates during freezing of a freezable liquid contained in each of the freezer containers.

2. The freezer container support structure according to claim 1, wherein each of the plates comprises a raised peripheral lip.

3. The freezer container support structure according to claim 1, wherein the straps maintain the plates in register.

4. The freezer container support structure according to claim 1, wherein the plates are movable with respect to the straps.

5. The freezer container support structure according to claim 1, wherein the plates each include notches that seat the straps to the plates.

6. The freezer container support structure according to claim 1, wherein the straps each include a buckle, the buckles permitting selective resizing of the straps to compress the freezer containers between the plates.

7. The freezer container support structure according to claim 1, wherein the straps are elasticized.

8. The freezer container support structure according to claim 1, wherein the plates each have a substantially quadrilateral shape.

9. The freezer container support structure according to claim 1, wherein a number of plates and freezer containers within the support structure is adjustable.

10. A method for storing freezable liquid for future selective access, comprising:

dispensing freezable liquid into one or more freezer containers;

positioning the freezer containers between two or more plates;

fitting straps around the plates in a spaced orientation;

compressing the freezer containers between the plates using the straps;

positioning the freezer containers in a freezer compartment; and sealing the freezer compartment.

11. The method of claim 10, wherein each of the plates comprises a raised peripheral lip.

12. The method of claim 10, wherein the straps maintain the plates in register.

13. The method of claim 10, wherein the plates are movable with respect to the straps.

14. The method of claim 10, wherein the plates each include notches that seat the straps to the plates.

15. The method of claim 10, wherein the straps each include a buckle, the buckles permitting selective resizing of the straps to compress the freezer containers between the plates.

16. The method of claim 10, wherein the straps are elasticized.

17. The method of claim 10, wherein the plates each have a substantially quadrilateral shape.

18. The method of claim 10, wherein a number of plates and freezer containers is adjustable.

* * * * *